US007671885B2

(12) United States Patent
Sasa

(10) Patent No.: US 7,671,885 B2
(45) Date of Patent: Mar. 2, 2010

(54) INK-JET RECORDING APPARATUS HAVING CURL RESTRAINING MECHANISM

(75) Inventor: Masahiko Sasa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 952 days.

(21) Appl. No.: 11/380,828

(22) Filed: Apr. 28, 2006

(65) Prior Publication Data

US 2006/0244803 A1 Nov. 2, 2006

(30) Foreign Application Priority Data

Apr. 28, 2005 (JP) ..... 2005-132194

(51) Int. Cl.
*B41J 2/435* (2006.01)
*B65H 31/00* (2006.01)

(52) U.S. Cl. ..... 347/262; 347/264; 271/209

(58) Field of Classification Search ..... 347/139, 347/153, 164, 262, 264; 271/18, 139, 160, 271/161, 177, 137, 138, 169, 209; 400/625, 400/646; 358/496
See application file for complete search history.

(56) References Cited

U.S. PATENT DOCUMENTS 4,349,186 A * 9/1982 Nakamura ..... 271/18
4,843,338 A 6/1989 Rasmussen et al.
6,322,068 B1 * 11/2001 Iemura et al. ..... 271/177
6,503,011 B2 * 1/2003 Kono ..... 400/646
6,848,850 B2 2/2005 Matsuo et al.
7,149,011 B2 * 12/2006 Kawamura et al. ..... 358/496
7,198,420 B2 * 4/2007 Yamamoto et al. ..... 400/625

FOREIGN PATENT DOCUMENTS

JP 1139286 A 5/1989
JP H05-058488 A 3/1993
JP 7132658 A 5/1995
JP 8040620 A 2/1996
JP 10017155 A * 1/1998
JP H10-017155 A 1/1998
JP 2003-326788 A 11/2003

OTHER PUBLICATIONS

Japan Patent Office, Notification of Reasons for Rejection mailed Oct. 28, 2008, in counterpart priority Patent Application No. JP 2005-132194.

* cited by examiner

*Primary Examiner*—Hai C Pham
(74) *Attorney, Agent, or Firm*—Baker Botts L.L.P.

(57) ABSTRACT

An ink-jet recording apparatus is provided which can perform image recording on a recording medium being conveyed while restraining a curl at the front end of the recording medium. The ink-jet recording apparatus has an upstream curve forming portion that curves a recording medium being conveyed into a nearly U-shape when viewed in a cross selection orthogonal to a conveying direction of the recording medium, and an upstream conveying direction change portion that shifts the conveying direction of the recording medium being conveyed from the feed tray to between a platen and a recording head such that the recording medium is curved to form a nearly U-shape when viewed in a cross section along the conveying direction.

10 Claims, 10 Drawing Sheets

INK-JET RECORDING APPARATUS HAVING CURL RESTRAINING MECHANISM

CROSS-REFERENCE TO RELATED APPLICATIONS

This application claims the benefit of Japanese Patent Application No. 2005-132194 filed Apr. 28, 2005 in the Japan Patent Office, the disclosure of which is incorporated herein by reference.

BACKGROUND

This invention relates to an ink-jet recording apparatus that performs image recording on a conveyed recording medium while controlling an upward curl at the front end of the recording medium.

Conventional ink-jet recording apparatus are known to perform image recording on a recording medium being conveyed on a platen by selectively ejecting ink from the nozzles of a recording head onto the recording medium while moving the recording head orthogonally to the conveying direction of the recording medium.

In this case, if there is a curl on a recording medium on which such ink-jet recording apparatus perform image recording, the recording medium is lifted during conveyance on the platen and this shortens the distance to the recording head. Thus, image recording is not performed in an orderly fashion. For example, in case of a large curl, the recording head may be brought into contact with the recording medium. Ink adhered to the nozzle face of the recording head may be transferred to the recording medium, thereby leading to a degradation of the image quality. Or, the recording medium may collide with the recording head and get jammed. In case of a small curl, ink from the recording head may not be ejected onto the targeted positions and the recorded image may be distorted. Also, white lines and dark-colored lines may appear in the recorded image and deteriorate the image quality.

Among the aforementioned ink-jet recording apparatus, there is an apparatus that guides a recording medium to between the platen and the recording head while suppressing the recording medium by two pinch rollers and a carriage guide, respectively provided upstream of the recording head, to prevent the recording medium from being lifted. Such an ink-jet recording apparatus curves the recording medium along a direction orthogonal to the conveying direction of the recording medium to correct the curl of the recording medium. Accordingly, the recording medium is evenly held on the platen and is not lifted.

SUMMARY

However, even in the aforementioned ink-jet recording apparatus, a conveyed recording medium is lifted from the platen, shortening the distance to the recording head, if there is an upward curl at the front end of the recording medium. Thus, there is a problem that a desired image is not recorded. In other words, a downward curl at the front end of a recording medium, for example, can be corrected by abutting the front end of the recording medium against the platen, guided by the two pinch rollers and the carriage guide. The recording medium is evenly held on the platen and is not lifted. On the other hand, an upward curl at the front end of a recording medium remains as it is even if the recording medium is guided by the two pinch rollers and the carriage guide. The recording medium conveyed on the platen is lifted and this shortens the distance to the recording head. As a result, image, recording is not successfully performed.

The present invention is made to solve the above problems. It would be desirable to provide an ink-jet recording apparatus that can perform image recording on a conveyed recording medium, while restraining a curl at the front end of the recording medium.

It is desirable that an ink-jet recording apparatus of the present invention includes: a feed tray that can mount a recording medium thereon; a conveying mechanism that conveys the recording medium from the feed tray; a platen that supports the recording medium conveyed by the conveying mechanism; a recording head that selectively ejects ink from nozzles onto the recording medium on the platen, while moving orthogonally to the direction of conveyance of the recording medium by the conveying mechanism to perform image recording on the recording medium; an upstream curve forming portion which curves the recording medium, conveyed by the conveying mechanism, into a nearly U-shape when viewed in a cross section orthogonal to the conveying direction; and an upstream conveying direction change portion which shifts the conveying direction of the recording medium, conveyed from the feed tray to between the platen and the recording head by the conveying mechanism, such that the recording medium is curved to form a nearly U-shape when viewed in a cross section along the conveying direction.

According to the ink-jet recording apparatus of the present invention, the recording medium being conveyed is curved to form a nearly U-shape when viewed in a cross section orthogonal to the conveying direction of the recording medium. Then, the conveying direction is shifted such that the recording medium is curved to form a nearly U-shape when viewed in a cross section along the conveying direction, so that the front end of the recording medium is pressed against the platen. More particularly, if a recording medium, conveyed from the feed tray to between the platen and the recording head by the conveying mechanism, is curled into a nearly U-shape when viewed in a cross section orthogonal to the conveying direction of the recording medium, the recording medium comes into a state curled along the conveying direction of the recording medium. This makes it difficult for the recording medium to be curled orthogonal to the conveying direction. Subsequently, the upstream conveying direction change portion shifts the conveying direction of the recording medium such that the recording medium is curved to form a nearly U-shape when viewed in a cross section along the conveying direction. As a result, the front end of the conveyed recording medium is pressed against the platen. Even if the recording medium is curled along a direction orthogonal to the conveying direction, the part of the recording medium located on the platen is flattened. Accordingly, regardless of an upward curl at the front end of the recording medium being conveyed, image recording can be performed with the curl being controlled.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

Figure 1:
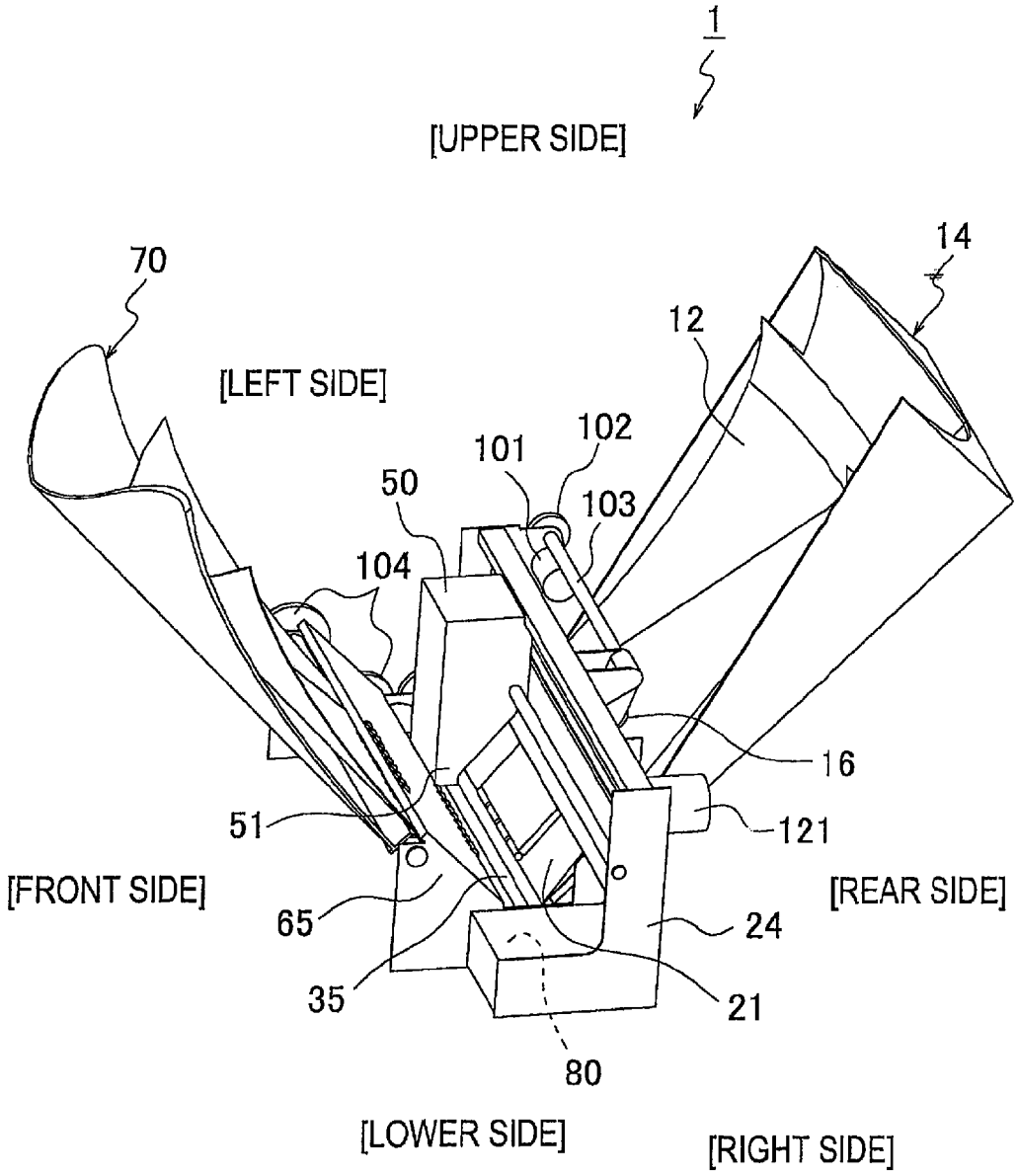
FIG. 1 is a perspective view of an ink-jet recording apparatus.

Hereinafter in an ink-jet recording apparatus 1, the side where there is a discharge tray is referred to as the "front side", and the side where there is a feed tray is referred to as the "rear side", as shown in FIG. 1. Likewise, the side where a recording head is located with respect to a platen is referred to as the "upper side", and the side where the platen is located with respect to the recording head is referred to as the "lower side". Furthermore, the "right side" and the "left side" are indicated as the right and left sides of the ink-jet recording apparatus 1 when viewed from the "front side" toward the "rear side".

[Description of Ink-Jet Recording Apparatus 1]

Figure 2:
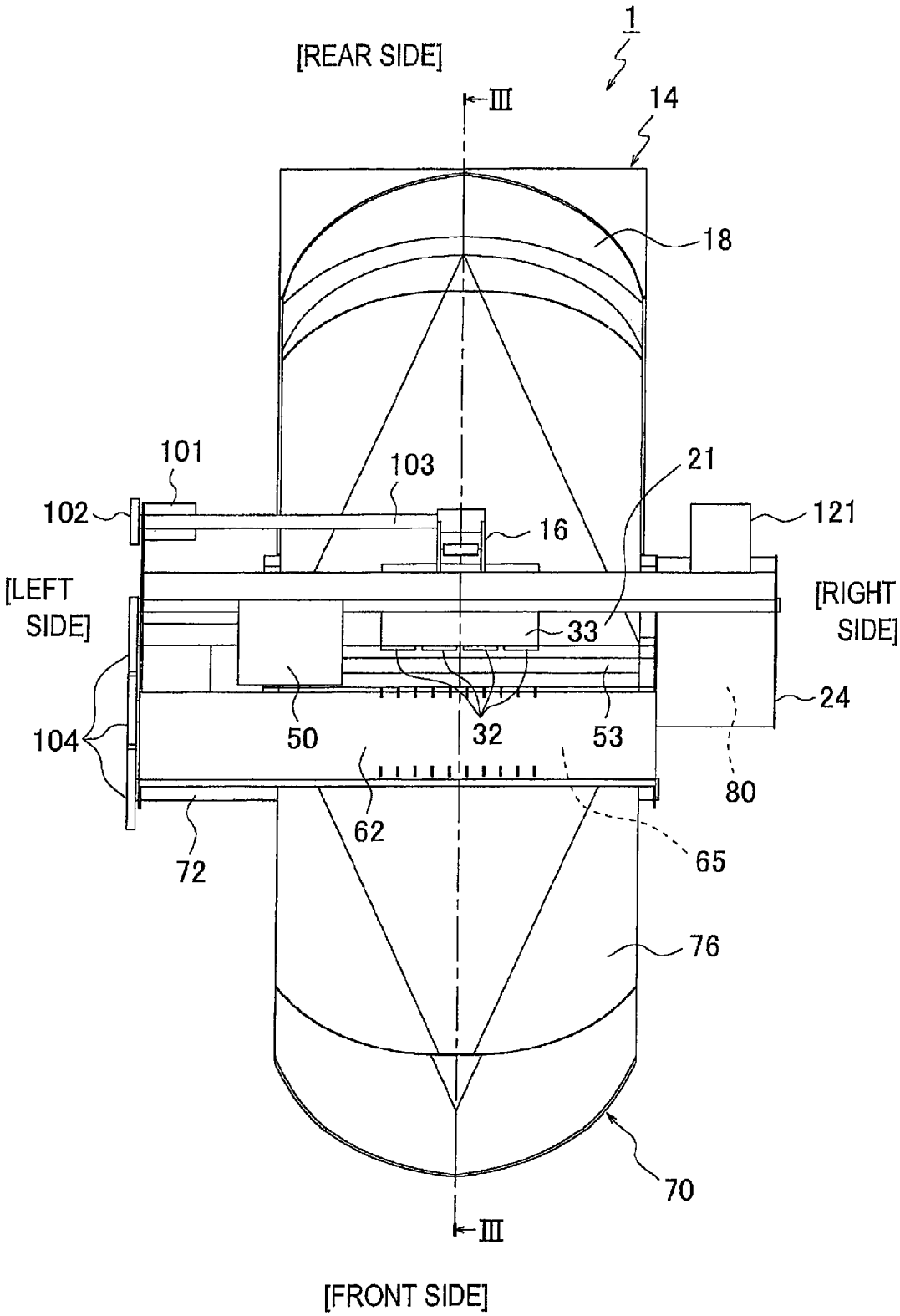
FIG. 2 is a plan view of the ink-jet recording apparatus.

Referring to FIGS. 1 and 2, the ink-jet recording apparatus 1 performs image recording onto a recording sheet 12 by selectively ejecting ink from nozzles of a recording head 51 mounted on a recording unit 50 onto the recording sheet 12 conveyed on a platen 35, while moving the recording unit 50 orthogonally to a conveying direction of the recording sheet 12.

[Description of Sheet Cassette 14]

Figure 3:
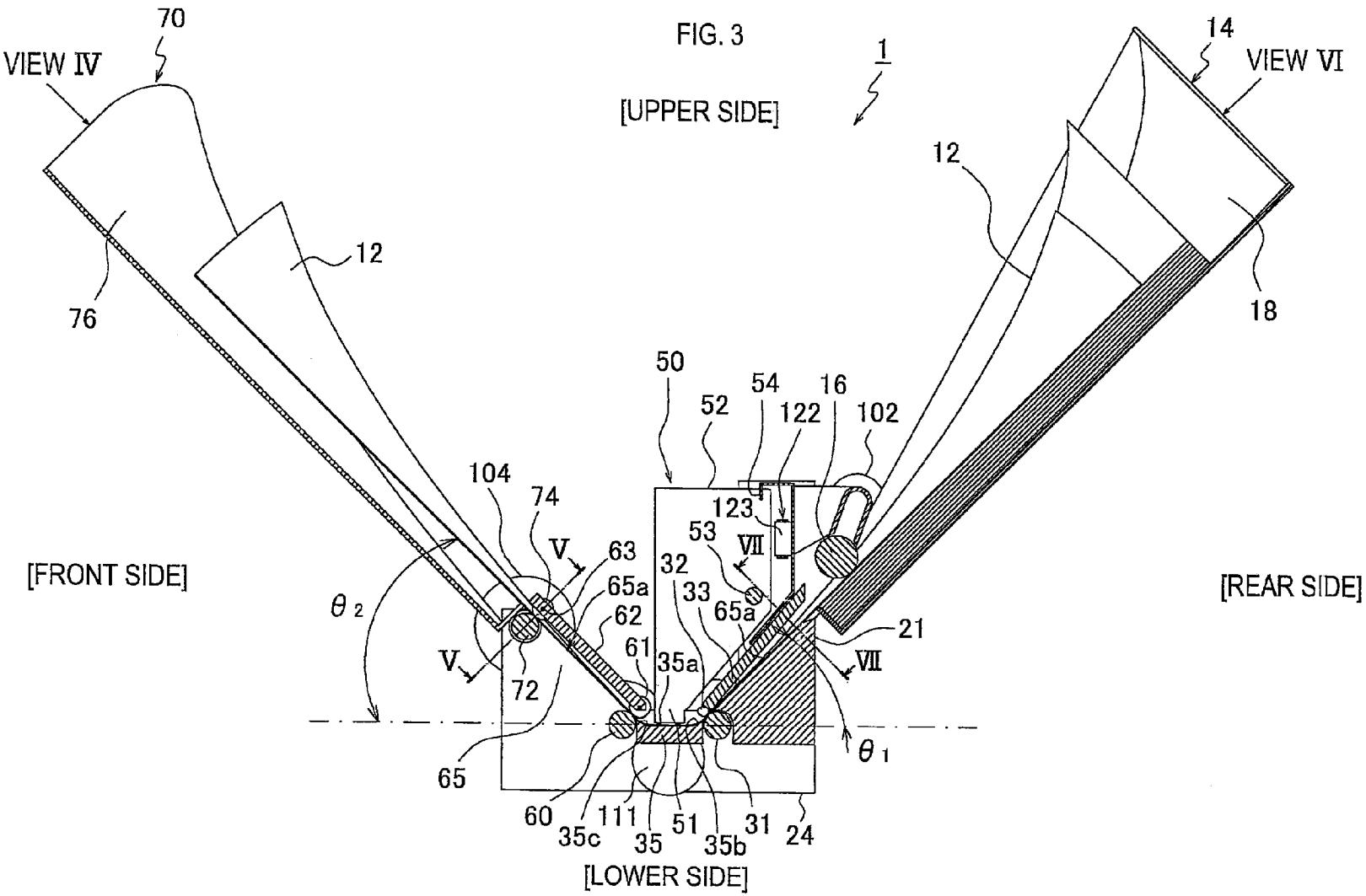
FIG. 3 is a cross sectional view taken by a line III-III in FIG. 2.

As shown in FIG. 3, a sheet cassette 14, which can store a plurality of recording sheets 12, is provided at the rear part of the ink-jet recording apparatus 1. A feed roller 16 is provided at the lower front portion of the feed cassette 14 where the feed roller 16 is brought into contact with the topmost recording sheet 12. The feed roller 16 has a rotational axis along the width direction of the recording sheet 12. The feed roller 16 can be rotated by a driving force of a drive motor 101 (see FIG. 1) via a gear group 102 and a shaft 103.

Figure 6:
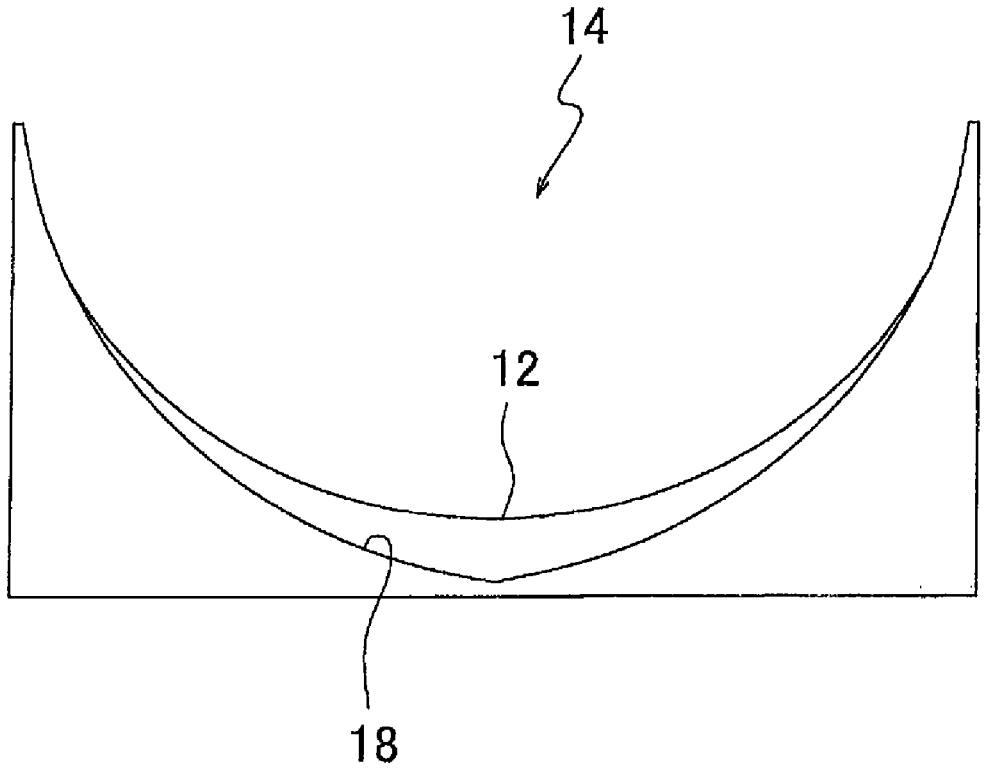
FIG. 6 is an explanatory view showing a schematic structure of a feed tray taken from a direction VI.

A feed tray 18, which mounts a recording sheet 12 thereon, is provided inside the feed cassette 14. The feed tray 18 is curved into a nearly U-shape (see FIG. 6) when viewed in a cross section orthogonal to the conveying direction of the recording sheet 12. The feed tray 18 is formed such that the degree of curvature is smaller toward an upstream guide 21. As a result, a recording sheet 12 placed on the feed tray 18 curves into a nearly U-shape when viewed in a cross section orthogonal to the conveying direction, and the degree of curvature of the recording sheet 12 becomes gradually smaller as the recording sheet 12 is conveyed. The feed tray 18 is biased toward the feed roller 16 by a not shown coil spring. That is, the recording sheet 12 on the feed tray 18 is brought into contact with the feed roller 16 by the biasing force of the coil spring, and conveyed on the upstream guide 21 by the feed roller 16, which is driven and rotated by the drive motor 101.

[Description of Upstream Guide 21]

The upstream guide 21 is oriented such that an angle $\theta_1$ (°), formed by a conveying surface 21*a* of the upstream guide 21 and a conveying surface 35*a* of a later-explained platen 35, is approximately 45°.

According to the inventor's experiments, a large driving force is not required to convey a recording paper 12, a curl does not remain on the recording paper 12, and a smooth change in the conveying direction of the recording paper 12 is achieved, if the angle $\theta_1$ is set to satisfy the following relational expression (i).

$$0<\theta_1 \leqq 70 \quad \text{(i)}$$

Figure 7:
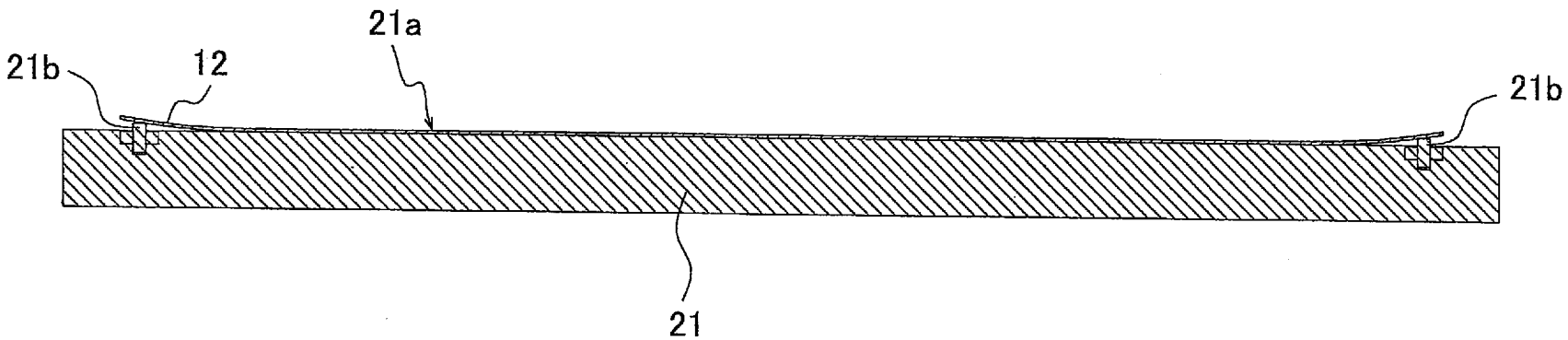
FIG. 7 is a cross sectional view taken by a line VII-VII in FIG. 3.

The upstream guide 21 is also provided with support rollers 21*b*, 21*b* on both sides for supporting both right and left sides of a recording sheet 12 (see FIG. 7).

[Description of Delivery Roller 31 and Holding Roller 32]

A feed/convey unit is provided at the front and obliquely downward of the feed roller 16 inside of a cover frame 24. The feed/convey unit includes a delivery roller 31 and a holding roller 32. The delivery roller 31 is driven and rotated by a motor. The holding roller 32 has a rotational axis parallel to a rotational axis of the delivery roller 31. The delivery roller 31 can be rotated by the driving force of a stepping motor 111 via a not shown gear group. The holding roller 32 is rotatably attached to a roller holder 33. The roller holder 33 is rotatably supported by an attachment shaft (not shown), and biased toward the delivery roller 31 by a not shown spring. That is, due to the biasing force of the spring, the surface of the holding roller 32 is pressed against the surface of the delivery roller 31. Thereby, a recording sheet 12 conveyed on the upstream guide 21 by the feed roller 16 is held between the delivery roller 31 and the holding roller 32 and delivered onto the conveying surface 35*a* of the platen 35.

Figure 10A:
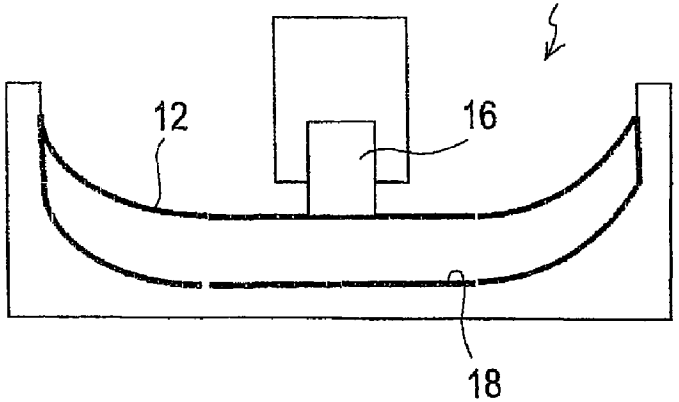
FIG. 10A is an explanatory view showing a schematic structure of the feed tray taken from a direction IXA in FIG. 9.
Figure 10B:
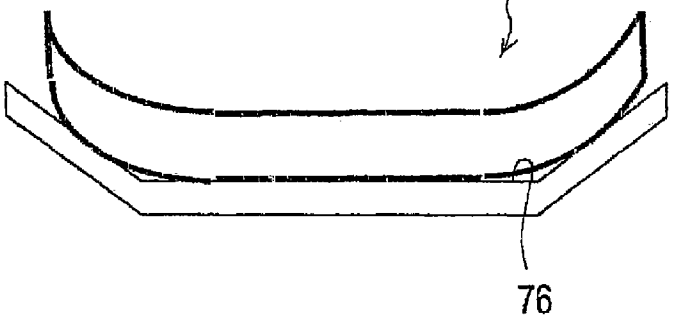
FIG. 10B is an explanatory view showing a schematic structure of the discharge tray taken from a direction IXB.
Figure 10C:
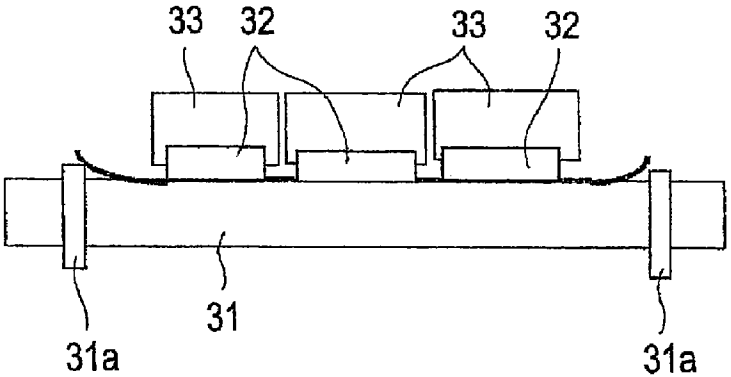
FIG. 10C is an explanatory view showing a schematic structure of a delivery roller and a holding roller taken by a line IXC-IXC.

The delivery roller 31 has supports 31*a*, 31*a* (see FIG. 10C) whose diameter is set larger than the diameter of the axial portion of the delivery roller 31. The supports 31*a*, 31*a* can support both left and right sides of a conveyed recording sheet 12.

[Description of Platen 35]

The aforementioned platen 35 is designed to support a recording sheet 12, conveyed by the delivery roller 31 and the holding roller 32, with the conveying surface 35*a*. A plurality of not shown ribs are formed on the conveying surface 35*a* of this platen 35 to extend in the conveying direction of the recording sheet 12.

An upstream end portion 35*b* of the platen 35 is formed such that the recording sheet 12 is curved to form a nearly U-shape when viewed in a cross section along the conveying direction of a recording sheet 12. That is, as is the case with the conveying surface 21*a* of the upstream guide 21, the angle $\theta_1$ (°), formed by the upstream end portion 35*b* and the conveying surface 35*a*, is approximately 45°. According to the inventor's experiments, if the angle $\theta_1$ is set to satisfy the above relational expression (i), the same effect as above can be achieved. The conveying direction of a recording sheet 12, conveyed from the feed tray 18 to between the platen 35 and the recording head 51 by the feed/convey unit, is shifted by the upstream end portion 35*b* of the platen 35 such that the recording sheet 12 is curved to form a nearly U-shape when viewed in a cross section along the conveying direction.

A downstream end portion 35*c* of the platen 35 is formed such that a recording sheet 12 is curved to form a nearly U-shape when viewed in a cross section along the conveying direction. That is, the downstream end portion 35*c* of the platen 35 is formed such that an angle $\theta_2$ (°), formed by the downstream end portion 35*c* and the conveying surface 35*a*, is approximately 45°.

According to the inventor's experiments, a large driving force is not required to convey a recording paper 12, a curl does not remain on the recording paper 12, and a smooth change in the conveying direction of the recording paper 12 is achieved if the angle $\theta_2$ is set to satisfy the following relational expression (ii).

$$0<\theta_2\leqq 70 \quad \text{(ii)}$$

As a result, the conveying direction of a recording sheet 12, discharged to a catch cassette 70 by the conveying mechanism, is shifted by the downstream end portion 35*c* of the platen 35 such that the recording sheet 12 is curved to form a nearly U-shape when viewed in a cross section along the conveying direction.

[Description of Recording Unit 50]

The recording unit 50 is provided inside the cover frame 24. The recording unit 50 includes the recording head 51 having a recording face opposed to the top surface of the platen 35.

A plurality of ink chambers, each with a piezoelectric element, are provided inside the recording head 51. Application of voltage to the piezoelectric element changes the volume in the ink chambers. The recording is performed by ejection of ink from nozzles formed in the ink chambers onto the upper surface of the recording sheet 12 on the conveying surface 35*a* of the platen 35.

The recording head 51 is mounted on a carriage 52. The carriage 52 is attached to guide bars 53, 54 provided in a width direction inside of the ink-jet recording apparatus 1. One end of the carriage 52 is fixed to an endless belt 122, which connects a drive pulley (not shown) and a driven pulley 123. The drive pulley is driven by a carriage drive motor 121. The carriage 52 reciprocates along the guide bars 53, 54 via the endless belt 122 by the carriage drive motor 121 (see FIG. 1), while the recording head 51 performs recording onto a recording sheet 12 in a width direction of the recording sheet 12.

[Description of Discharge Roller 60 and Spur Rollers 61]

Figure 10D:
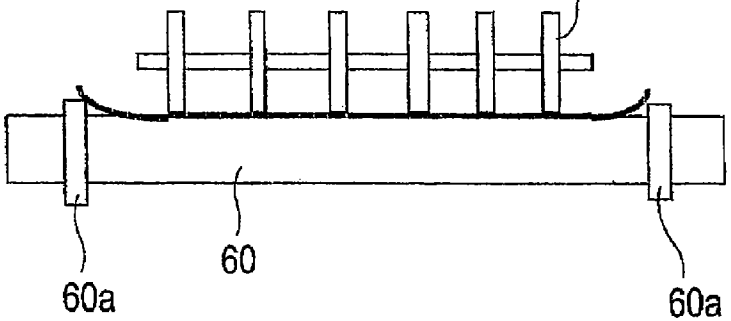
FIG. 10D is an explanatory view showing a schematic structure of a discharge roller and spur rollers taken by a line IXD-IXD.

A discharge/convey unit, including a discharge roller 60 and spur rollers 61, is provided downstream of the recording head 51. The discharge roller 60 is driven and rotated by a motor. A recording sheet 12, on which image recording has been performed, is held between the discharge roller 60 and the spur rollers 61 to be discharged. The discharge roller 60 can be rotated via a not shown gear group by the driving force of the aforementioned stepping motor 111. The discharge roller 60 is also provided with supports 60*a*, 60*a* whose diameter is set larger than the diameter of the axial portion of the discharge roller 60. The supports 60*a*, 60*a* can support both right and left ends of a conveyed recording sheet 12 (see FIG. 10D).

Each spur roller 61 is made of a thin plate material with a plurality of sharp-pointed protrusions around the outer periphery. That is, the ink is not dried on the upper surface of a recording sheet 12 on which image recording has been performed. Therefore, the use of a rubber roller having a large contact area is not appropriate, unlike in other non-ink-jet printers. Instead, the spur rollers 61 are used having a small contact area. Also, the spur rollers 61 are rotatably attached to a plate-like spur roller holder 62. The spur roller holder 62 is rotatably supported by an attachment shaft 63 and is biased toward the discharge roller 60 by a not shown spring. That is, the surface of each spur roller 61 is pressed against the surface of the discharge roller 60 by the biasing force of the spring. Thereby, a recording sheet 12, on which image recording has been performed by the recording head 51 on the platen 35, is held between the discharge roller 60 and the spur rollers 61 and is discharged onto a downstream guide 65.

[Delivery Amount of Delivery Roller 31 and Discharge Roller 60]

As noted above, the delivery roller 31 and the discharge roller 60 are respectively rotationally driven by the stepping motor 111 and the gear group. The delivery amount of the discharge roller 60 is set to be slightly smaller than the delivery amount of the delivery roller 31 by means of a friction clutch provided in a drive transmission which drives the discharge roller 60. As a result, when a recording sheet 12 is conveyed downstream by the delivery roller 31 and the discharge roller 60, the recording sheet 12 is resisted by the slipping of the discharge roller 60 and the spur rollers 61 and can be conveyed in a flattened state.

[Description of Downstream Guide 65]

The downstream guide 65 is formed such that the angle $\theta_2$ (°), formed by the conveying surface 65*a* and the conveying surface 35*a* of the platen 35, is approximately 45°, as is the case with the downstream end portion 35*c* of the platen 35. According to the inventor's experiments, if the angle $\theta_2$ is set to satisfy the aforementioned relational expression (ii), a large driving force is not required to convey a recording paper 12, a curl does not remain on the recording paper 12, and a smooth change in the conveying direction of the recording paper 12 is achieved.

[Description of Catch Cassette 70]

Figure 5:
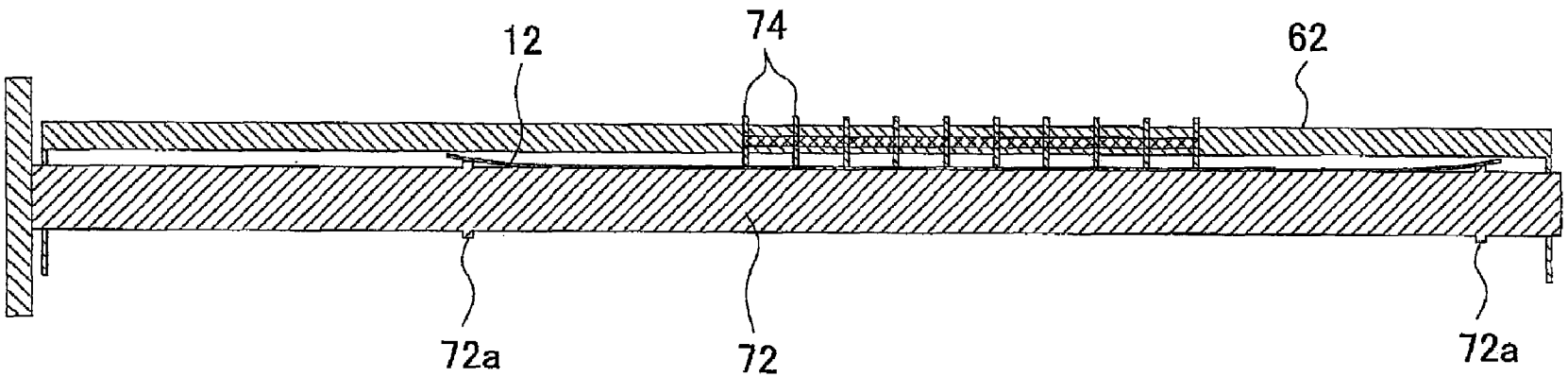
FIG. 5 is a cross sectional view taken by a line V-V in FIG. 3.

The catch cassette 70, which can store a plurality of recording sheets 12 on which image recording has been performed, is provided at the front of the ink-jet recording apparatus 1. A catch roller 72 and spur rollers 74 are provided at the rear of the catch cassette 70 and at the portion in contact with a topmost recording sheet 12. The catch roller 72 has a rotational axis along a width direction of the recording sheet 12. The recording sheet 12 is held between the catch roller 72 and the spur rollers 74 to be discharged. The catch roller 72 can be rotated via the gear group 104 by the driving force of the aforementioned drive motor 101 (see FIG. 1). The catch roller 72 is also provided with supports 72*a*, 72*a* whose diameter is set larger than the diameter of the axial portion of the catch roller 72. The supports 72*a*, 72*a* can support both right and left ends of a conveyed recording sheet 12 (see FIG. 5).

Figure 4:
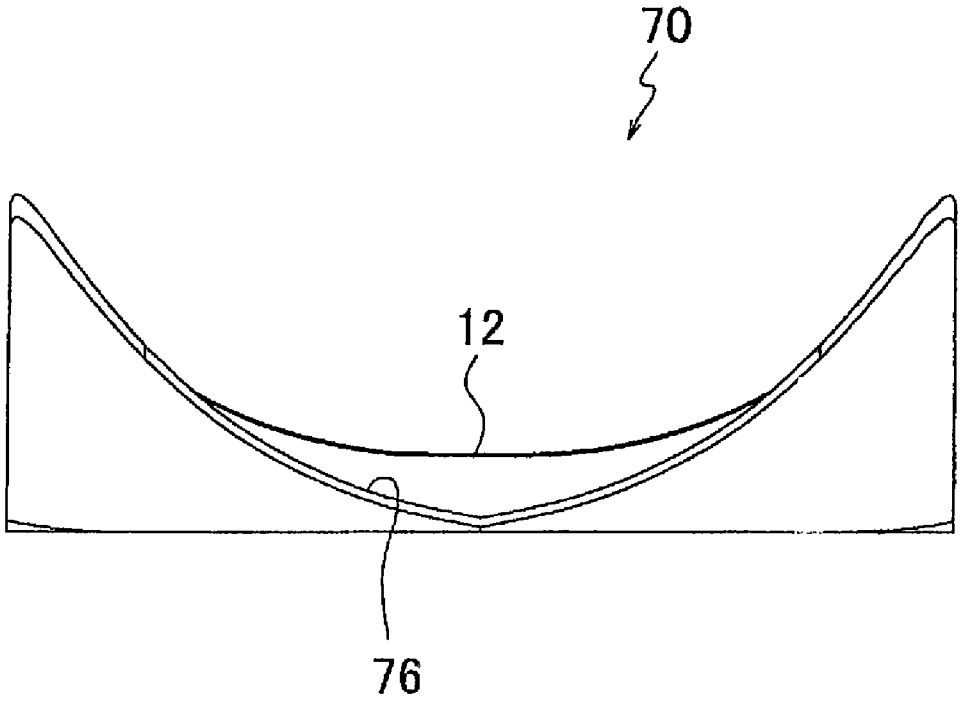
FIG. 4 is an explanatory view showing a schematic structure of a discharge tray taken from a direction IV.

A catch tray 76, for receiving a recording sheet 12 on which image recording has been performed by the recording head 51, is provided inside of the catch cassette 72. The catch tray 76 is curved into a nearly U-shape when viewed in a cross section orthogonal to the conveying direction of the recording sheet 12 (see FIG. 4). The degree of curvature of the catch tray 76 is formed to be larger as the distance from the downstream guide 65 is increased. As a result, a recording sheet 12 placed on the catch tray 76 is curved to form a nearly U-shape when viewed in a cross section orthogonal to the conveying direction. The degree of curvature becomes gradually larger as the recording sheet 12 is conveyed.

[Description of Maintenance Mechanism 80]

The ink-jet recording apparatus 1 is provided with a maintenance mechanism 80 that does maintenance of the recording head 51. The maintenance mechanism 80 includes a wiper (not shown), a cap (not shown), and a drive motor (not shown). The wiper wipes a head face of the recording head 51.

The cap can seal a nozzle group of the recording head 51. The drive motor respectively drives the wiper and the cap.

Other components of the ink-jet recording apparatus 1 are based on well known art. Therefore, a detailed explanation of the other components is not provided.

[Description of Recording Operation of Ink-Jet Recording Apparatus 1]

Figure 9:
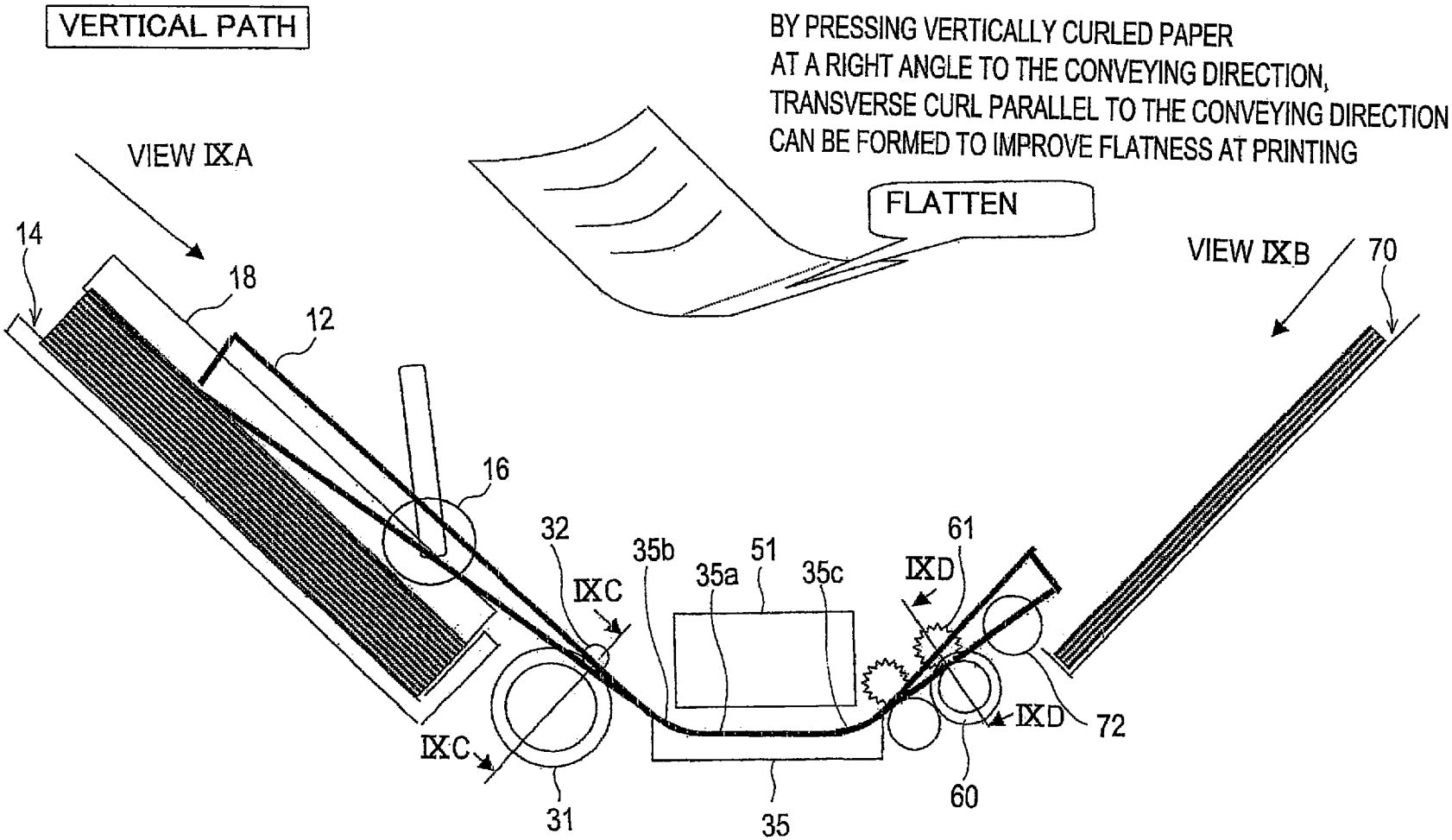
FIG. 9 is an explanatory view showing the recording sheet being conveyed.

Now, the recording operation of the ink-jet recording apparatus 1 is described referring to FIG. 9. FIG. 9 is an explanatory view showing a recording sheet 12 being conveyed.

A recording sheet 12, stored in the sheet cassette 14, is curved to form a nearly U-shape, when viewed in a cross section orthogonal to the conveying direction. The recording sheet 12 is in a state deformed by the feed tray 18 (see FIG. 10A) such that the degree of curvature becomes gradually smaller as the recording sheet 12 is conveyed. The recording sheet 12, deformed by the feed tray 18, is delivered to the delivery roller 31 on and along the upstream guide 21 by the feed roller 16 rotating counterclockwise. The recording sheet 12, conveyed on the upstream guide 21, is brought into a state in which both right and left ends of the recording sheet 12 are lifted by the support rollers 21*b*, 21*b* (see FIG. 7).

Figure 8:
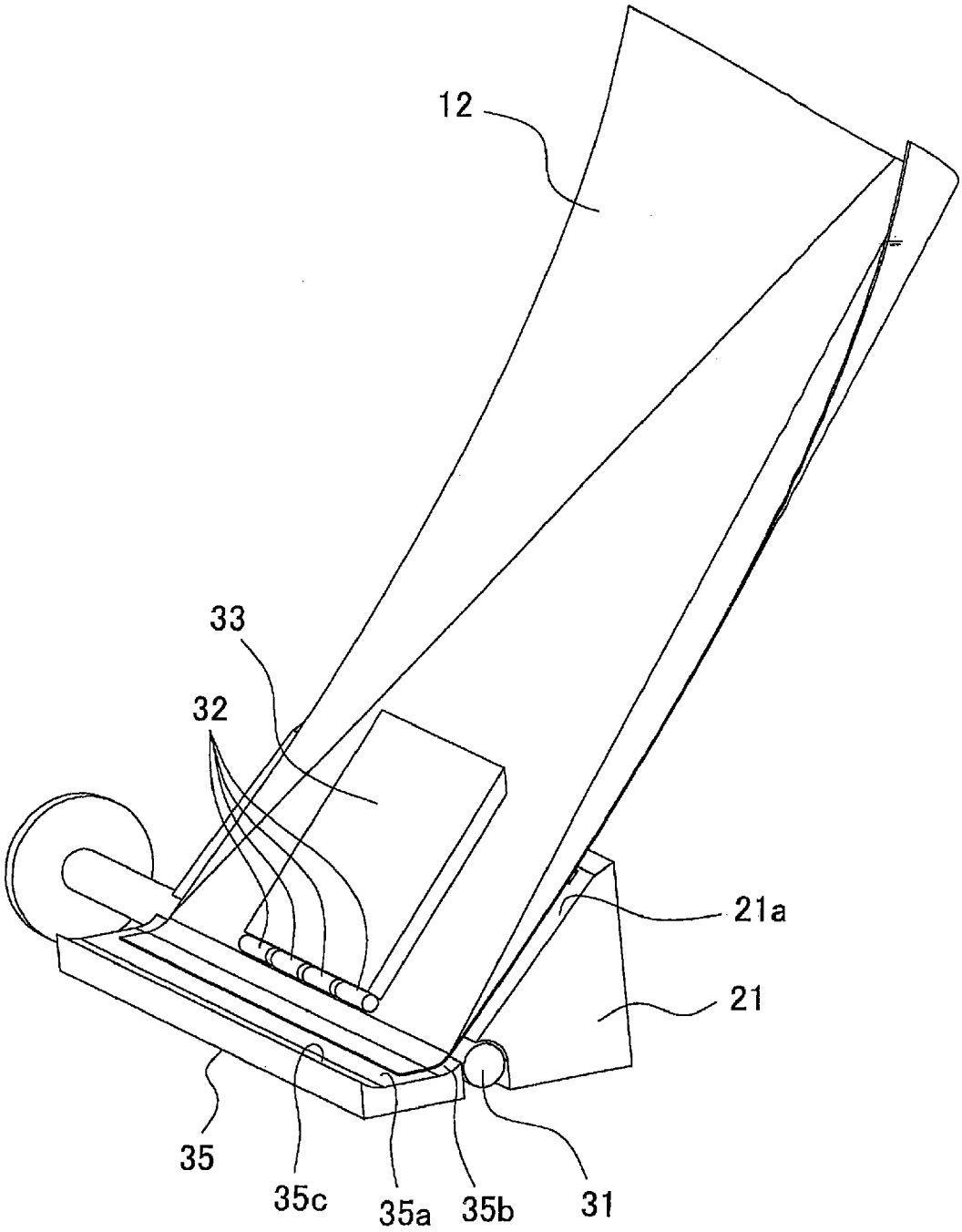
FIG. 8 is an explanatory view showing a state in which a recording sheet is curved to form a nearly U-shape when viewed in a cross section orthogonal to a conveying direction of the recording medium, and the conveying direction is shifted such that the recording medium is curved to form a nearly U-shape when viewed in a cross section along the conveying direction.

Subsequently, the recording sheet 12, delivered on and along the upstream guide 21, is held between the delivery roller 31 rotating clockwise and the holding roller 32 rotating counterclockwise, and delivered onto the conveying surface 35*a* of the platen 35. In this case, the conveying direction of the part of the recording sheet 12, located on the upstream end portion 35*b* of the platen 35, is shifted by the upstream end portion 35*a* of the platen such that the part is curved to form a nearly U-shape when viewed in a cross section along the conveying direction. As a result, the front end of the recording sheet 12 is pressed against the conveying surface 35*a* of the platen 35, and the part of the recording sheet 12 located on the conveying surface 35*a* of the platen 35 is flattened, even if the recording sheet 12 was curled along a direction orthogonal to the conveying direction (see FIG. 8). Also, the recording sheet 12 is brought into a state in which both the right and left ends thereof are lifted by the supports 31*a*, 31*a* (see FIG. 10C).

When the recording sheet 12 reaches the conveying surface 35*a*, rotation of the delivery roller 31 is suspended, and the recording head 51 is driven. While moving along the travel direction of the carriage 52, the recording head 51 ejects ink onto the upper surface of the recording sheet 12 for recording. When the recording head 51 completes recording for one line, the delivery roller 31 again rotates and delivers the recording sheet 12 to the next recording position, and the same operation as above is performed.

After repeated recording and delivery, the recording sheet 12 is held between the discharge roller 60 and the spur rollers 61 and discharged onto the catch tray 76 of the catch cassette 70. In this case, the conveying direction of the part of the recording sheet 12, located on the downstream end portion 35*c* of the platen 35, is shifted by the downstream end portion 35 of the platen 35 such that the part is curved to form a nearly U-shape when viewed in a cross section along the conveying direction. Also, the recording sheet 12 is brought into a state in which both the right and left ends thereof are lifted by the supports 60*a*, 60*a* of the discharge roller 60 (see FIG. 10D). Moreover, the recording sheet 12 is deformed by the catch tray 76 such that the recording sheet 12 is curved to form a nearly U-shape when viewed in a cross section orthogonal to the conveying direction and that the degree of curvature becomes gradually larger as the recording sheet 12 is conveyed (see FIG. 10B). As a result, the part of the recording sheet 12 located on the conveying surface 35*a* of the platen 35 is pressed against the platen 35 and flattened. The recording sheet 12, received in the catch tray 76, is brought into a state in which both the right and left ends thereof are lifted by the supports 72*a*, 72*a* of the catch roller 72 (see FIG. 5).

[Effects]

(1) According to the ink-jet recording apparatus 1 of the present embodiment, a recording sheet 12 stored in the sheet cassette 14 is curved to form a nearly U-shape when viewed in a cross section orthogonal to the conveying direction. The recording sheet, when being conveyed, is deformed by the feed tray 18 such that the degree of curvature becomes gradually smaller. Furthermore, the conveying direction of the recording sheet 12, delivered onto the conveying surface 35*a* of the platen 35 by the delivery roller 31, and the holding roller 32, is shifted by the upstream end portion 35*b* of the platen 35 such that the recording sheet 12 is curved to form a nearly U-shape when viewed in a cross section along the conveying direction. Therefore, the front end of the recording sheet 12 is pressed against the conveying surface 35*a* of the platen 35. Even if the recording sheet 12 was curled along a direction orthogonal to the conveying direction, the part of the recording sheet 12 located on the conveying surface 35*a* of the platen 35 is flattened (see FIG. 8). Accordingly, the ink-jet recording apparatus 1 of the present embodiment can perform recording while controlling the curl of the recording sheet 12.

(2) According to the ink-jet recording apparatus 1 of the present embodiment, the feed tray 18 is curved into a nearly U-shape when viewed in a cross section orthogonal to the conveying direction of a recording sheet 12. The degree of curvature is smaller toward the upstream guide 21. Such a constitution enables the upstream guide 21 to smoothly shift the conveying direction of the recording sheet 12.

(3) According to the ink-jet recording apparatus 1 of the present embodiment, the support rollers 21*b*, 21*b* of the upstream guide 21 lift both right and left ends of a recording sheet 12 conveyed on the upstream guide 21. Furthermore, the supports 31*a*, 31*a* of the delivery roller 31 lift both the right and left ends of the recording sheet 12. Therefore, it is possible for the upstream guide 21 to smoothly shift the conveying direction of the recording sheet 12.

(4) According to the ink-jet recording apparatus 1 of the present embodiment, the upstream guide 21 is formed such that the angle $\theta_1$ (°), formed by the conveying surface 21*a* of the upstream guide 21 and the conveying surface 35*a* of the platen 35, is approximately 45°. Therefore, a large driving force is not required to convey a recording paper 12, a curl does not remain on the recording paper 12, and a smooth change in the conveying direction of the recording paper 12 is achieved. According to the inventor's experiments, if the angle $\theta_1$ is set to satisfy the aforementioned relational expression (i), the same effects as above can be achieved.

(5) According to the ink-jet recording apparatus 1 of the present embodiment, the sheet feeding amount of the delivery roller 31 is set to be slightly larger than the sheet feeding amount of the discharge roller 60. Therefore, a recording sheet 12, when being conveyed downward by both the delivery roller 31 and the discharge roller 60, is resisted by the slipping of the discharge roller 60 and the spur rollers 61 so that the recording sheet 12 can be conveyed in a flattened state. That is, no tensile force operates on the recording sheet 12. There is no concern that a part of the recording sheet 12, located on the conveying surface 35*a* of the platen 35, is lifted.

(6) According to the ink-jet recording apparatus 1 of the present embodiment, the conveying direction of a recording sheet 12, discharged by the discharge roller 60 and the spur rollers 61, is shifted by the downstream end portion 35*c* of the platen 35 such that the recording sheet 12 is curved to form a U-shape when viewed in a cross section along the conveying direction. Moreover, the recording sheet 12 is curved to form a U-shape when viewed in a cross section orthogonal to the conveying direction. The recording sheet 12, when being conveyed, is brought into a deformed state by the discharge tray 76 such that the degree of curvature becomes gradually larger (see FIG. 10B). As a result, the part of the recording sheet 12 located on the conveying surface 35*a* of the platen 35 is pressed against the platen 35 and flattened. Therefore, even if a part of the recording sheet 12 which has passed the upstream guide 21 is larger than the other part, recording can be performed onto the recording sheet 12 while the curl of the recording sheet 12 is still under control.

(7) According to the ink-jet recording apparatus 1 of the present embodiment, the discharge tray 76 is curved into a nearly U-shape when viewed in a cross section orthogonal to the conveying direction of a recording sheet 12. The degree of curvature is formed to be larger as the distance from the downstream guide 65 is increased. Such a constitution enables the downstream guide 65 to smoothly shift the conveying direction of the recording sheet 12.

(8) According to the ink-jet recording apparatus 1 of the present embodiment, the supports 60*b*, 60*b* of the discharge roller 60 lift both right and left ends of a recording sheet 12 being conveyed. Furthermore, the supports 72*a*, 72*a* of the discharge roller 72 lift both the right and left ends of the recording sheet 12. Therefore, it is possible for the downstream guide 65 to smoothly shift the conveying direction of the recording sheet 12.

(9) According to the ink-jet recording apparatus 1 of the present embodiment, the downstream guide 65 is formed such that the angle $\theta_2$ (°), formed by the conveying surface 65*a* of the downstream guide 65 and the conveying surface 35*a* of the platen 35, is approximately 45°. Therefore, a large driving force is not required to convey a recording paper 12, a curl does not remain on the recording paper 12, and a smooth change in the conveying direction of the recording paper 12 is achieved. According to the inventor's experiments, if the angle $\theta_2$ is set to satisfy the aforementioned relational expression (ii), the same effects as above can be achieved.

An embodiment of the present invention is described in the above. However, the present invention can be practiced in various manners without departing from the technical scope of the invention.

In the above embodiment, the sheet feeding amount of the discharge roller 60 is set to be slightly smaller than the sheet feeding amount of the delivery roller 31 by means of a friction clutch provided in the drive transmission which drives the discharge roller 60. However, a recording sheet 12 can be delivered in a flattened state by slipping the discharge roller 60 and a recording sheet 12 by friction. Even with this constitution, no tensile force operates on the recording sheet 12. There is no concern that the part of the recording sheet 12 located on the conveying surface 35*a* of the platen 35 is raised.

What is claimed is:

1. An ink-jet recording apparatus comprising:

a feed tray that can mount a recording medium thereon, a conveying mechanism that conveys the recording medium from the feed tray, a platen that supports the recording medium conveyed by the conveying mechanism, a recording head that selectively ejects ink from nozzles of the recording head onto the recording medium on the platen while moving orthogonally to a conveying direction of the recording medium by the conveying mechanism to perform image recording on the recording medium, an upstream curve forming portion which curves at least a portion of the recording medium as the recording medium is conveyed from the feed tray by the conveying mechanism into a first U-shape when viewed in a cross section orthogonal to the conveying direction, and an upstream conveying direction change portion which shifts the conveying direction of the recording medium conveyed from the feed tray to between the platen and the recording head by the conveying mechanism which curves at least a portion of the recording medium into a second U-shape when viewed in a cross section along the conveying direction, wherein an inner surface of the first U-shaped portion of the recording medium formed by the upstream curve forming portion is the same surface of the recording medium, which becomes the inner surface of the second U-shaped portion of the recording medium formed by the upstream conveying direction change portion.

2. The ink-jet recording apparatus according to claim 1, wherein the upstream curve forming portion is formed such that a degree, at which the recording medium conveyed by the conveying mechanism is curved to form a nearly U-shape cross section orthogonal to the conveying direction of the recording medium, is smaller as a distance to the upstream conveying direction change portion is closer.

3. The ink-jet recording apparatus according to claim 1, wherein the upstream conveying direction change portion shifts the conveying direction of the recording sheet such that an angle $\theta_1$ (°), formed by a conveying direction of the recording medium conveyed from the feed tray by the conveying mechanism and a conveying direction of the recording medium conveyed between the platen and the recording head, satisfies the following relational expression (i), $$0<\theta_1\leqq 70 \quad \text{(i)}.$$

4. The ink-jet recording apparatus according to claim 1, further comprising a biasing unit that biases a part of the recording sheet conveyed by the conveying mechanism, which has passed between the platen and the recording head, to a direction opposite to the conveying direction of the recording medium.

5. The ink-jet recording apparatus according to claim 1, wherein the upstream curve forming portion and the upstream conveying direction change portion are provided in the feed tray.

6. The ink-jet recording apparatus according to claim 1, further comprising:

a downstream conveying direction change portion that shifts the conveying direction of the recording medium on which image recording has been performed by the recording head such that the recording medium is curved to form a U-shape when viewed in a cross section along the conveying direction, and a downstream curve forming portion that curves the recording medium of which conveying direction is shifted by the downstream conveying direction change portion after image recording has been performed by the recording head thereon, into a nearly U-shape when viewed in a cross section orthogonal to the conveying direction.

7. The ink-jet recording apparatus according to claim 6, wherein the downstream curve forming portion is formed such that a degree, at which the recording medium conveyed by the conveying mechanism is curved to form a nearly U-shape cross section orthogonal to the conveying direction of the recording medium, is larger as a distance from the downstream conveying direction change portion is increased.

8. The ink-jet recording apparatus according to claim 6, wherein the downstream conveying direction change portion shifts the conveying direction of the recording medium such that an angle $\theta_2$ (°), formed by a conveying direction of the recording medium on which image recording has been performed by the recording head and a conveying direction of the recording medium conveyed toward the downstream curve forming portion, satisfies the following relational expression (ii), $$0<\theta_2\leqq 70 \quad \text{(ii)}.$$

9. The ink-jet recording apparatus according to claim 1, wherein the inner surface of the first U-shaped portion of the recording medium is opposite to the feed tray.

10. The ink-jet recording apparatus according to claim 1, wherein the inner surface of the second U-shaped portion of the recording medium faces the recording head when the recording medium is supported by the platen.

* * * * *